US007775071B2

(12) United States Patent
Agbay

(10) Patent No.: US 7,775,071 B2
(45) Date of Patent: Aug. 17, 2010

(54) PRE-LOADED BARREL LOCK

(75) Inventor: Anthony John Agbay, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 0 days.

(21) Appl. No.: 11/928,575

(22) Filed: Oct. 30, 2007

(65) Prior Publication Data

US 2008/0105006 A1 May 8, 2008

Related U.S. Application Data

(60) Provisional application No. 60/864,074, filed on Nov. 2, 2006.

(51) Int. Cl.
*E05B 67/36* (2006.01)

(52) U.S. Cl. ..... 70/34; 70/38 A; 70/164; 70/366; 70/379 R; 70/386; 70/DIG. 42

(58) Field of Classification Search ..... 70/34, 70/164, 386, DIG. 42, 286, 379 R, 379 A, 70/380, 38 A, 366, 422, DIG. 54, DIG. 36, 70/DIG. 53; 292/256.6
See application file for complete search history.

(56) References Cited

U.S. PATENT DOCUMENTS

| | | | | | |
|---|---|---|---|---|---|
| 1,643,480 | A * | 9/1927 | Wiswell | 70/247 |
| 2,427,436 | A * | 9/1947 | Beems et al. | 292/164 |
| 3,089,329 | A * | 5/1963 | Kerr | 70/135 |
| 3,310,642 | A * | 3/1967 | Zeller | 200/43.08 |
| 3,691,799 | A * | 9/1972 | Hoffmann et al. | 70/84 |
| 3,793,856 | A * | 2/1974 | Lippisch | 70/38 A |
| 4,193,276 | A * | 3/1980 | Lundberg | 70/34 |
| 4,637,234 | A * | 1/1987 | Mielonen | 70/34 |
| 4,689,977 | A * | 9/1987 | Wolniak et al. | 70/379 R |
| 5,086,631 | A * | 2/1992 | Agbay | 70/366 |
| 5,363,678 | A * | 11/1994 | Meckbach | 70/38 A |
| 5,428,978 | A * | 7/1995 | Tsukano | 70/386 |
| 5,634,357 | A * | 6/1997 | Nutter et al. | 70/210 |
| 5,829,280 | A * | 11/1998 | Chen | 70/49 |
| 6,185,966 | B1 * | 2/2001 | Chen | 70/366 |
| 6,439,016 | B1 * | 8/2002 | Wittwer et al. | 70/379 R |
| 6,467,316 | B1 * | 10/2002 | Chen | 70/56 |
| 6,553,793 | B1 * | 4/2003 | Chen | 70/33 |
| 6,591,645 | B1 * | 7/2003 | Wittwer | 70/366 |
| 6,662,484 | B1 * | 12/2003 | Andree et al. | 42/70.11 |
| 6,684,670 | B1 * | 2/2004 | Agbay et al. | 70/164 |
| 2003/0159479 | A1 * | 8/2003 | Kajuch et al. | 70/379 R |
| 2003/0196461 | A1 * | 10/2003 | Liou | 70/38 A |
| 2004/0227354 | A1 * | 11/2004 | Pantke et al. | 292/201 |
| 2006/0101879 | A1 * | 5/2006 | Velicanin | 70/379 R |

* cited by examiner

*Primary Examiner*—Lloyd A Gall
(74) *Attorney, Agent, or Firm*—McCormick, Paulding & Huber LLP

(57) ABSTRACT

A lock assembly including a first lock portion having an open end which receives a key. The assembly further includes a second lock portion operatively connected to the first lock portion and a spring operatively attached to the first and second lock portions. Wherein one of the first and second lock portions is capable of biased rotational movement independent of the other of the first and second lock portions.

5 Claims, 13 Drawing Sheets

PRE-LOADED BARREL LOCK

CROSS REFERENCE TO RELATED APPLICATIONS

This application claims priority from U.S. Provisional Application No. 60/864,074, filed on Nov. 2, 2006, entitled "PRE-LOADED LOCK ASSEMBLY," which is hereby incorporated by reference in its entirety.

FIELD OF THE INVENTION

The present invention relates generally to a pre-loaded barrel lock and more particularly to a pre-loaded rotatable barrel lock for use in the utility industry that eliminates the need for an installation key.

BACKGROUND OF THE INVENTION

Utility boxes, such as electric meter boxes, are typically secured to prevent unauthorized access to the meter. Many of such boxes are secured through the use of split ring that is placed directly around the meter and locked through the use of a barrel lock. Other utility boxes, referred to as "ringless" boxes, do not include a lockable meter ring. Ringless boxes are secured by placing a lock assembly containing a barrel lock on either a side wall or a bottom wall of the box.

In either case, utility personnel and contractors hired to install barrel locks are given security keys to do so. Each utility, however, has only one key combination so a single key can gain access to ever lock in the entire system. Moreover, these keys are at times lost or stolen which creates a security problem for the utility company.

Furthermore, installation with a key is slower and therefore more costly than installing a pre-loaded lock. Installation of a split ring and barrel lock with the use of a barrel lock key involves multiple steps including, inserting the key into lock, activating the key and removing the lock, installing the ring onto the meter, inserting the lock into the meter ring and reactivating and removing the key.

In view of the above, known barrel locks are often pre-loaded into meter rings. Known preloaded locks, however, are limited to "plunger" style barrel locks. Plunger style barrel locks generally have a hollow barrel with a plunger that reciprocates axially within a bore of the barrel to lock or unlock the barrel lock. While plunger style barrel locks can offer security and variety of different lock mechanisms, design impediments exist which limit the number of possible configurations. Moreover, it may be possible to defeat plunger locks to gain unauthorized access to a meter box.

Certain rotatable disk style barrel locks present a solution to the inherent limitations of a plunger style barrel lock. An example of such a lock is described in U.S. Pat. No. 5,086,631, which is hereby incorporated by reference in its entirety. Known rotatable disk barrel locks are not, however, preloadable.

With the forgoing concerns in mind, it is the general object of the present invention to provide a preloaded rotatable disk barrel lock that eliminates the need for an installation key thereby providing a level of security unavailable with known locks. Moreover, it is a general object to provide a preloaded rotatable disk barrel lock which simplifies and expedites the installation process by eliminating the need for a key.

SUMMARY OF THE INVENTION

It is an object of the present invention to provide a preloaded barrel lock.

It is an object of the present invention to provide a preloaded rotatable barrel lock and other locking devices.

It is another object of the present invention to provide a preloaded rotatable disk style barrel lock that eliminates the need for an installation key thereby providing an increased level of security.

It is another object of the present invention to provide a preloaded rotatable disk style barrel lock that simplifies and expedites the installation process by eliminating the need for an installation key.

It is an object of the present invention to provide a preloaded lock rotatable disk style barrel lock for use with utility meter boxes.

It is another object of the present invention to provide a preloaded rotatable disk style barrel lock is preloaded into a split ring for installation on a utility meter box.

These and other objectives of the present invention, and their preferred embodiments, shall become clear by consideration of the specification, claims and drawings taken as a whole.

DETAILED DESCRIPTION OF THE INVENTION

Figure 1:
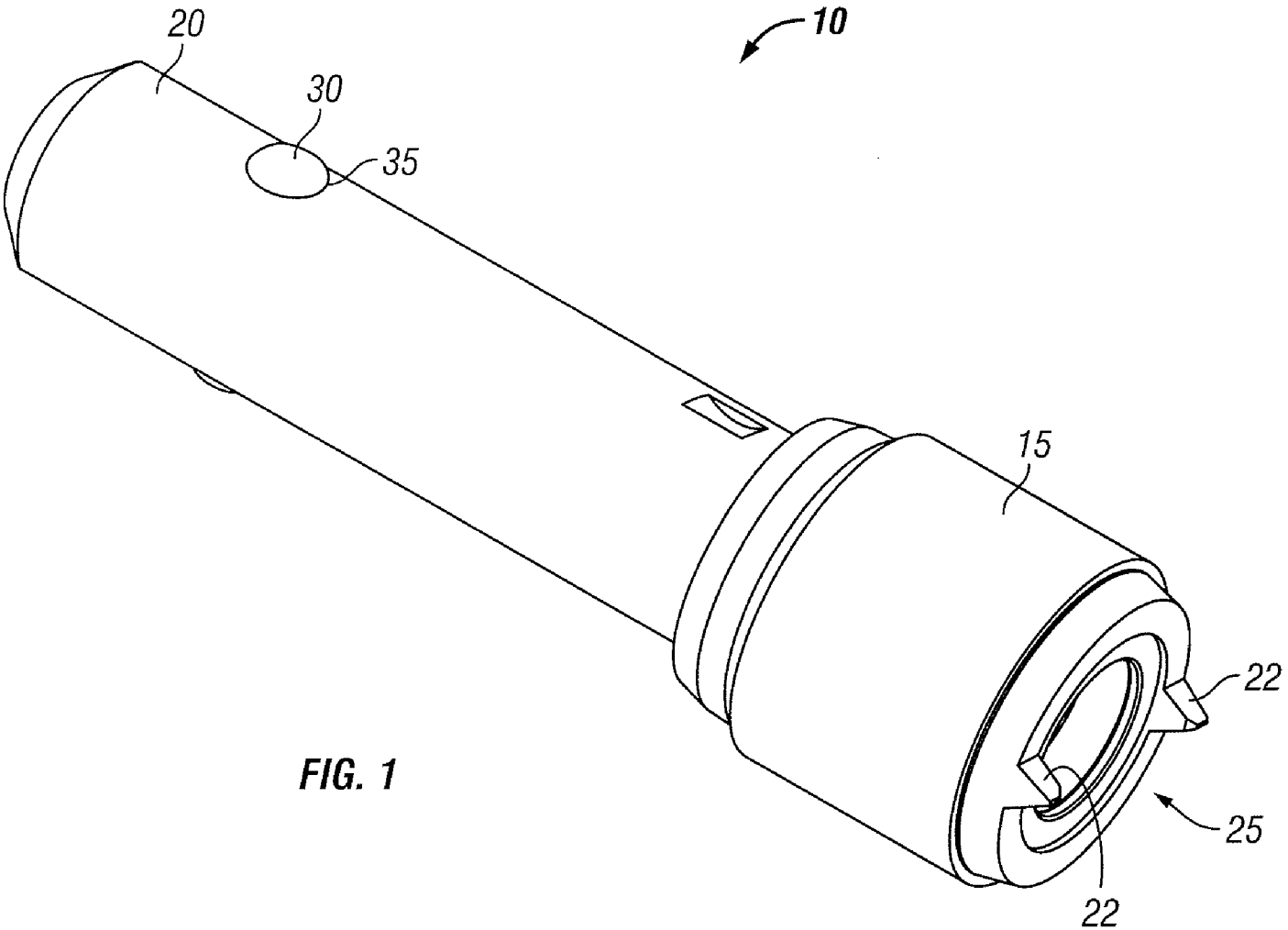
FIG. 1 is a perspective view of a preloaded barrel lock in accordance with an embodiment of the present invention.

Referring to FIG. 1, the preloaded rotatable disk style barrel lock 10 of the present invention includes a head portion 15 and cylindrical barrel body 20 extending therefrom. The combination of the head portion 15 and cylindrical barrel body may generally be referred to as the housing, as shown in FIG. 1. The barrel body 20 includes a cylindrical internal passageway 25. The head portion 15 includes a series of protrusions 22 which engage a key (not shown) to prevent rotation of the entire lock 10 upon removal. As shown, the barrel body 20 further includes locking balls 30 which are situated in and protrude from radial openings 35 in the barrel body 20. As will be appreciated, the locking balls 30 are configured to engage corresponding recesses in a locking device.

Figure 3:
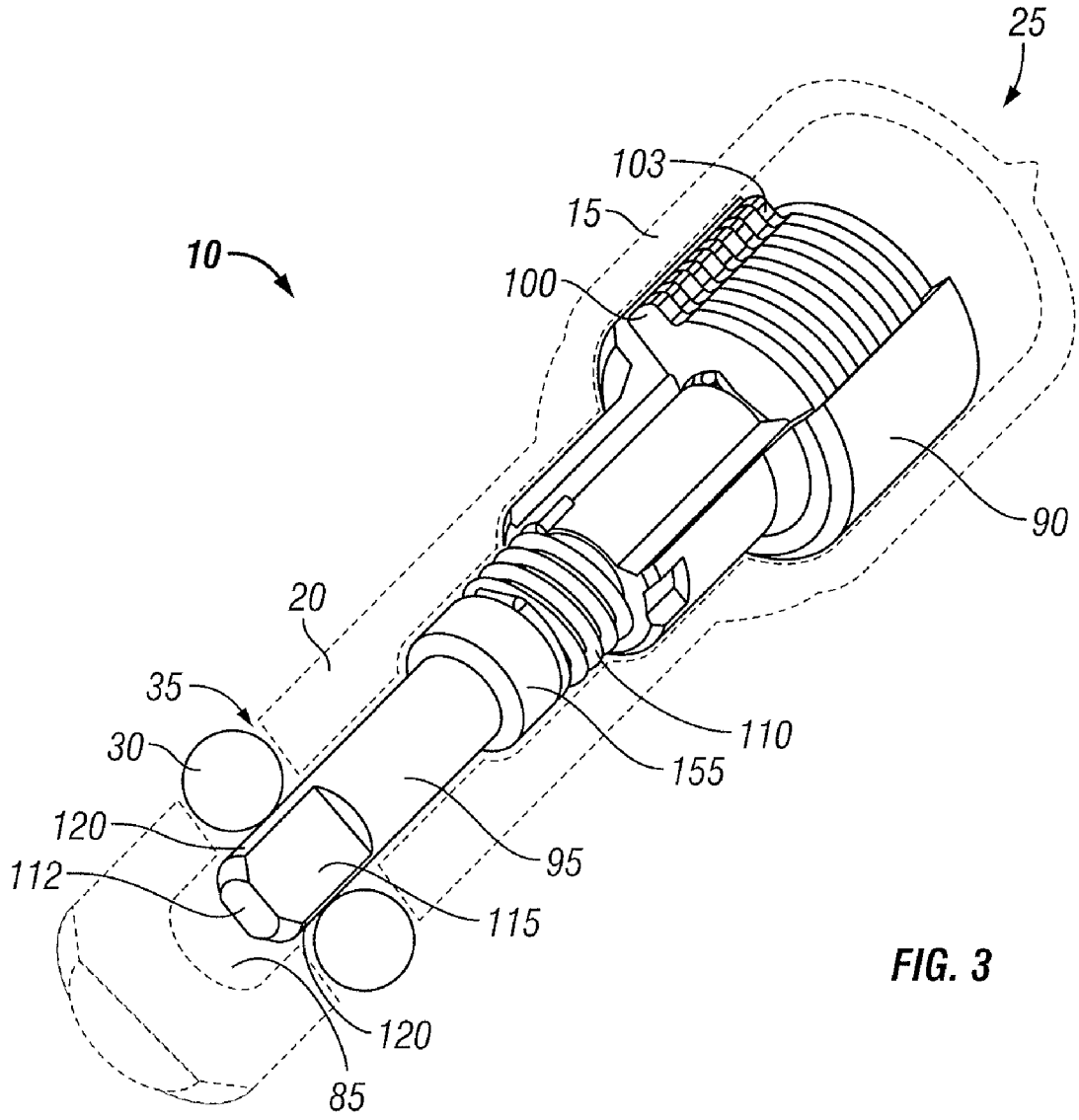
FIG. 3 is a cutaway perspective view of the preloaded barrel lock of FIG. 1 illustrating a cylinder, stem and biasing means.
Figure 14:
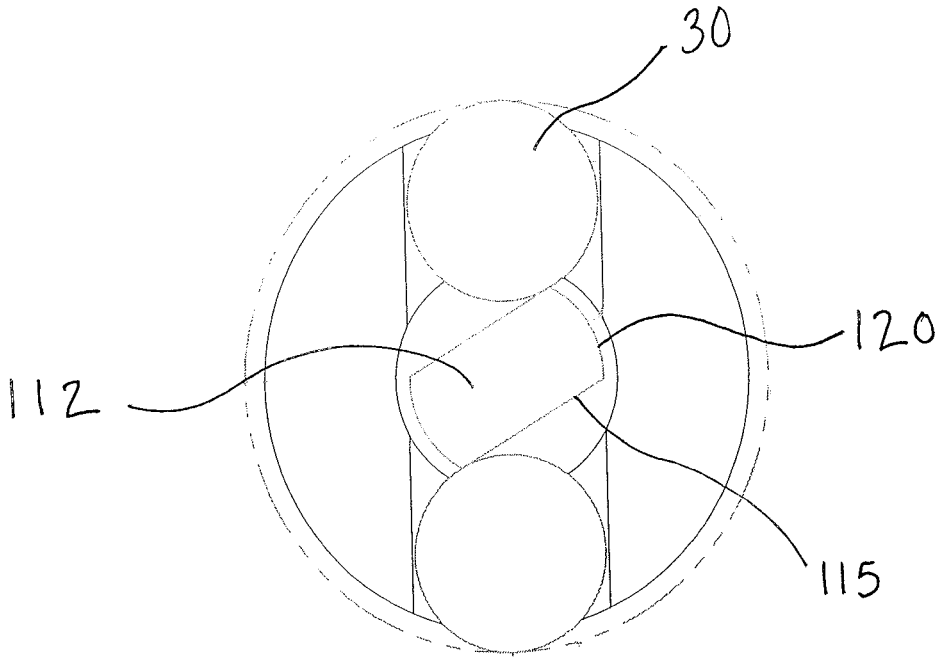
FIG. 14 is an enlarged end view of the preloaded barrel lock of FIG. 3 illustrating the lock balls partially biased outward by the stem in a preloaded position.

FIG. 14 is an enlarged end view of the preloaded barrel lock of FIG. 3 illustrating the lock balls partially biased outward by the stem in a preloaded position.

Figure 15:
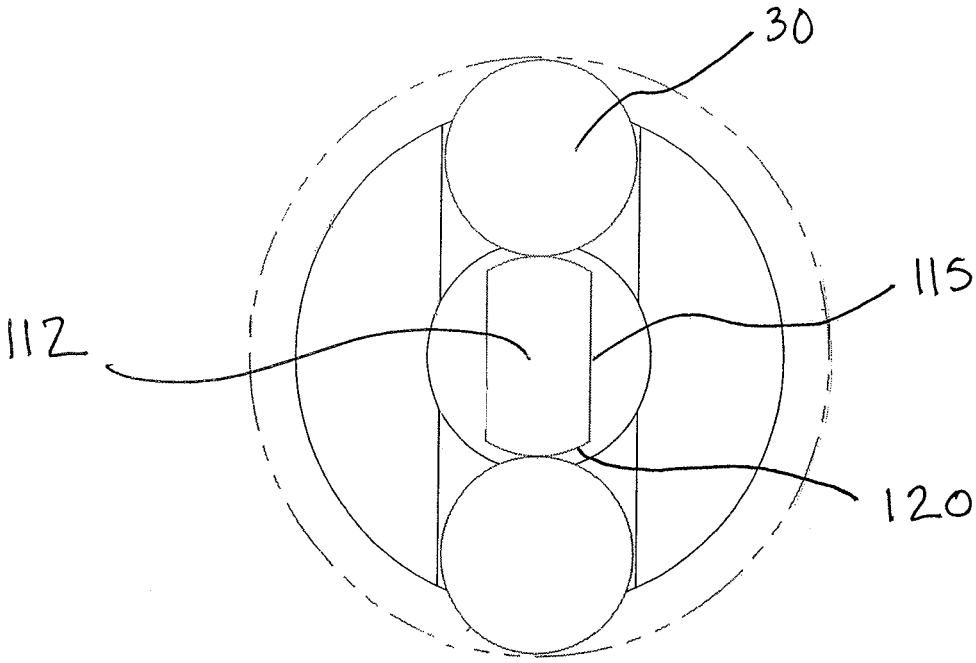
FIG. 15 is an enlarged end view of the preloaded barrel lock of FIG. 3 illustrating the lock balls completely biased by the stem in a fully locked position.

FIG. 15 is an enlarged end view of the preloaded barrel lock of FIG. 3 illustrating the lock balls completely biased by the stem in a fully locked position.

Figure 2A:
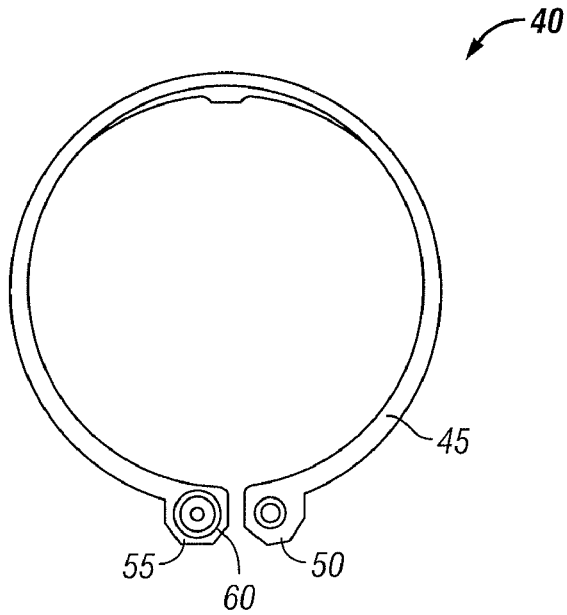
FIG. 2A Prior Art
FIGS. 2A-2C are views of a split meter ring in which the preloaded barrel lock of FIG. 1 may be employed.
Figure 2B:
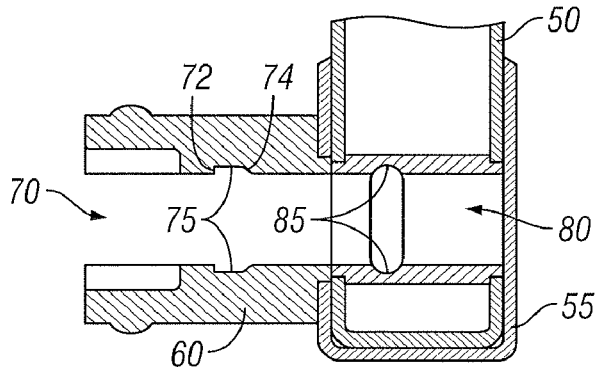
FIG. 2B Prior Art
Figure 2C:
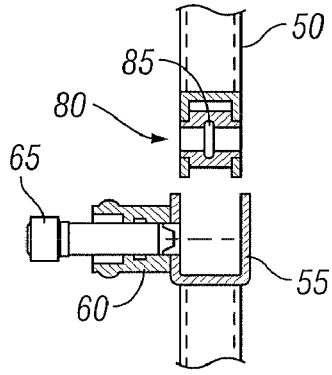
FIG. 2C Prior Art

More specifically, the locking balls 30 are configured to engage recesses, in, for example, known preloadable split retaining rings. As shown in FIGS. 2A-2C, known rings 40 have a curved side wall 45 which extends from a male end 50 to a female end 55. The female end includes an open-ended collar 60 into which a plunger-style barrel lock 65 is placed. An interior 70 of the collar 60 includes relatively shallow recesses 75 that engage locking balls to hold a lock assembly in a preloaded condition. As will be appreciated, there are other means for preloading the inventive lock, such as a collar with a straight bore as opposed to recessed 75.

The male end 50 includes a bushing 80 which can be brought into axial alignment with the collar 60. The bushing 80 includes a second, deeper set of recesses 85 which accept the balls when the lock is pushed through the collar 60 of the female end 55 and into the bushing 80 of the male end 50 to secure the ring.

As stated previously, however, the only known barrel locks that may be preloaded into such split retaining rings are plunger type locks which have potential drawbacks. In particular, plunger locks may be easier to defeat and have fewer locking combinations than rotating disk barrel locks. The present invention overcomes the potential drawbacks through the use of a preloadable, rotating disk barrel lock. It is important to note, however, that the present invention may be used with other rotating barrel locks that do not utilize disks such as a pin and tumbler type lock.

Figure 4:
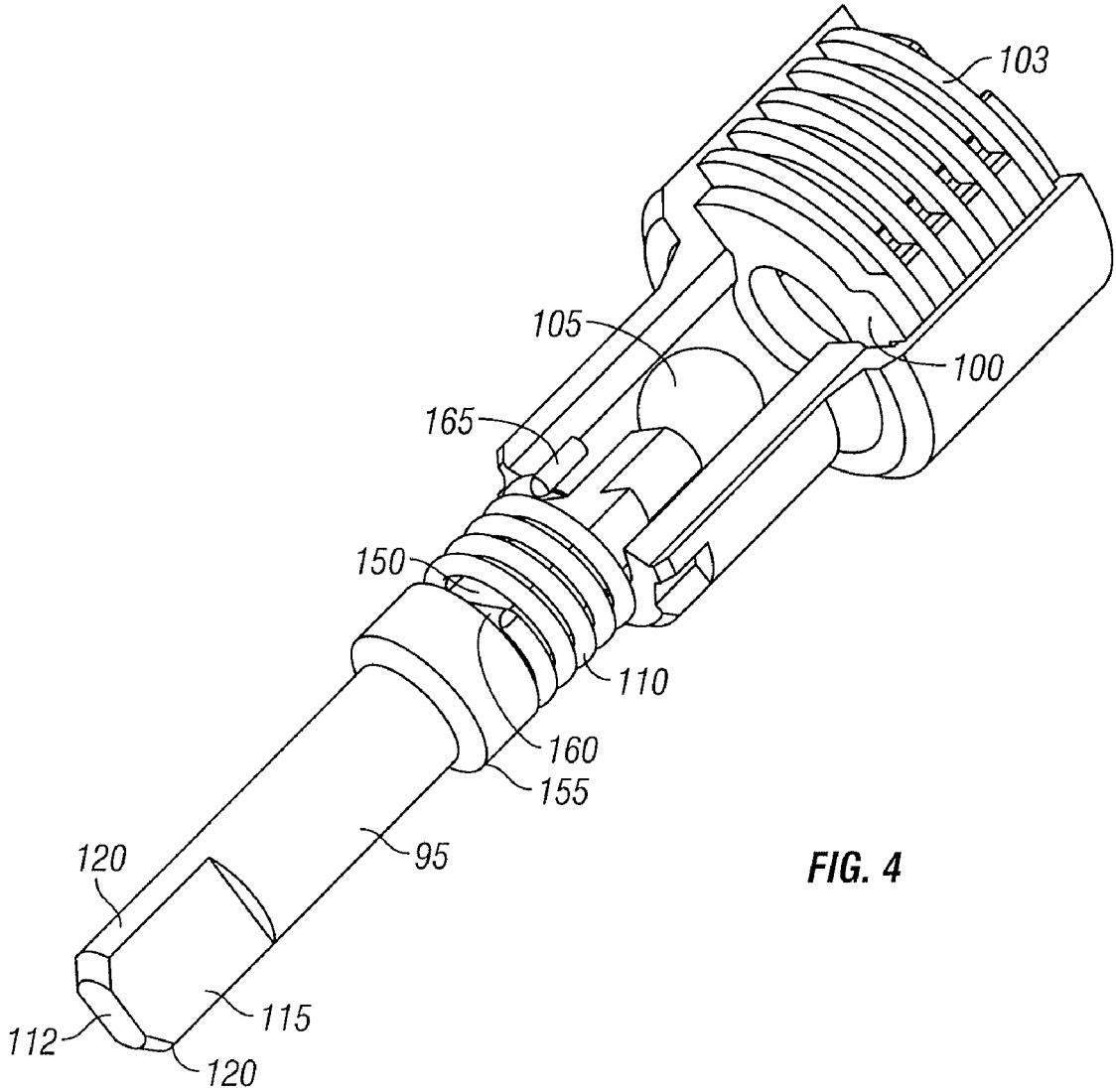
FIG. 4 is an additional perspective view of the cylinder, stem and biasing means of the preloaded barrel lock of FIG. 1.

FIGS. 3-4 illustrate generally the internal components of the barrel lock 10 which are housed within the head portion 15 and barrel body 20 (FIG. 1). In particular, the cylindrical internal passageway 25 of the head 15 and body 20 has a series of reduced diameter sections which terminate in a narrowed blind bore 85. Within the passageway 25 are a cylinder 90 and a stem portion 95 extending axially from the cylinder 90. The cylinder 90 contains combination disks 100 spaced apart by washers 103. The disks and washers, which operate to lock and unlock the inventive lock, are described more fully in U.S. Pat. No. 5,086,631, which is incorporated by reference in its entirety.

The cylinder 90 also includes a hardened steel ball 105. The ball 105 is located in a bore of the cylinder to prevent attempts to drill out the lock. As shown, the stem 95 extends from the cylinder 90 into the blind bore 85. Importantly, the stem 95 is a separate component from the cylinder 90 and is rotatably attached to the cylinder 90 along with a means for rotationally biasing the stem 95 relative to the cylinder 90, preferably a spring 110. As discussed in greater detail below, the two-piece, biased cylinder 90 and stem 95 allow for relative rotational movement that, in turn, enables the lock to be preloaded.

With reference to FIGS. 14 and 15, the stem 95 further includes a first or terminal end portion 112 with opposing flats 115. When the stem 95 is rotated so that the flats 115 are beneath the balls 30, the balls 30 are retracted into the radial openings 35. Conversely, when the cylindrical portions 120 are beneath the balls 30, they are biased outward from the openings 35 so that they may engage recesses in a collar 60 or bushing 80 of a split meter ring 40 (FIGS. 2A-2C). As will be readily appreciated, it is the rotational movement of the stem 95 that urges the balls 30 outward.

Figure 5:
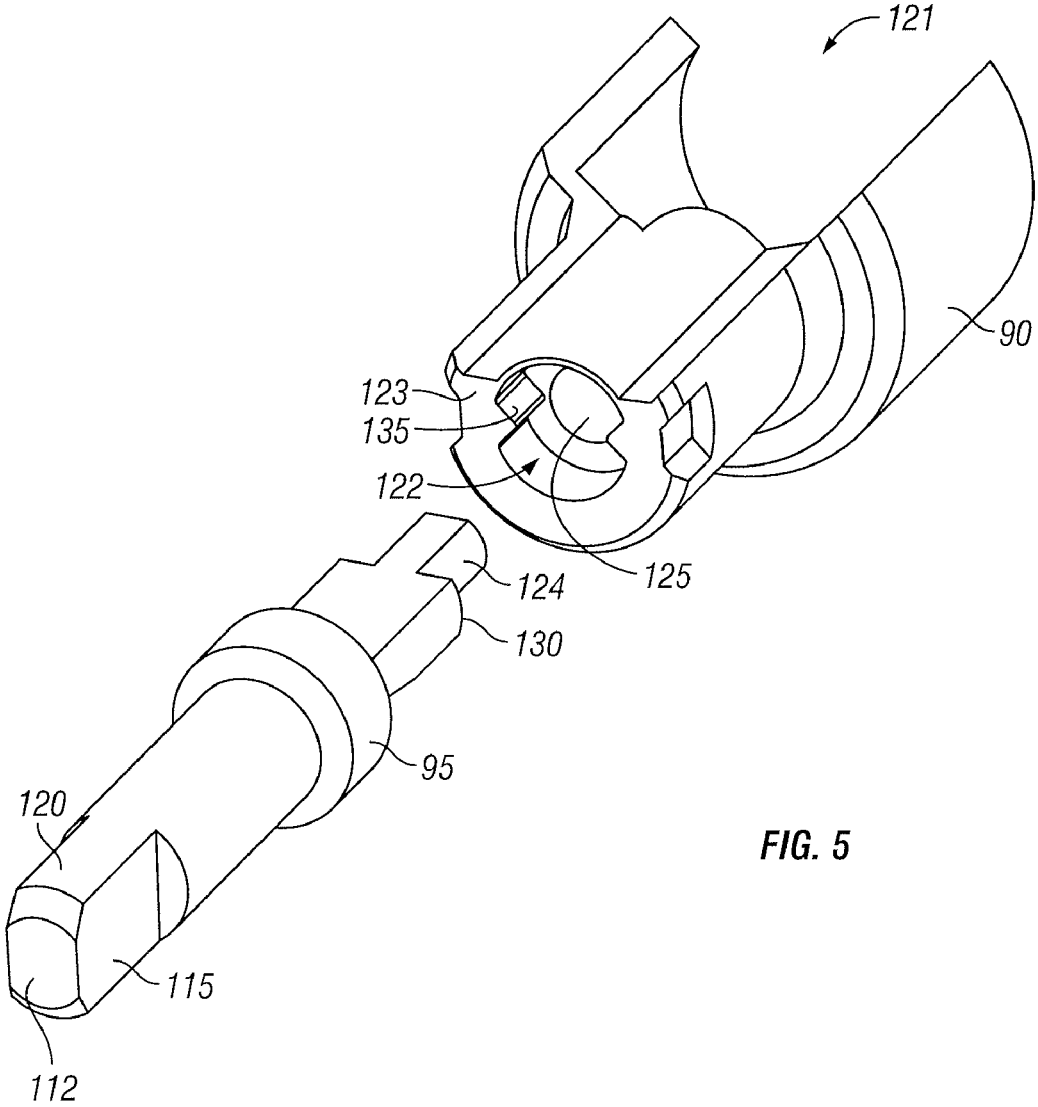
FIG. 5 is an enlarged perspective view of the cylinder and stem of the preloaded barrel lock of FIG. 3.

Referring now to FIG. 5, the cylinder 90 has opposing ends. An open end 121, which contains the combination disks and washers utilized to lock and unlock the inventive lock, and a stem end 123 which includes a machined recess 122 in which resides a bore 125. The bore 125 serves as a means for rotatably securing the stem 95 to the cylinder 90. As such, the bore 125 is shaped to receive a reduced diameter attachment end 124 of the stem 95, which is opposite the terminal end portion containing the flats 115. The bore 125 is configured to allow rotational movement of the attachment end 124. The attachment end 124 is illustrated as being partially cylindrical with cut-away or chamfered sides, however, as will be appreciated, the attachment end 124 may be completely cylindrical as long as rotation is enabled.

Figure 6C:
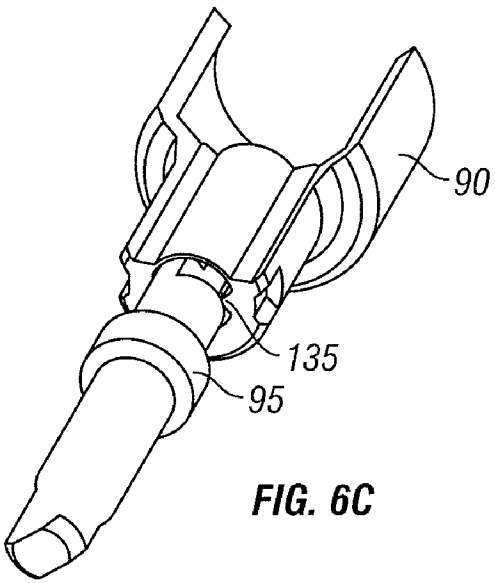
FIGS. 6A-6C are various enlarged exploded views of the cylinder and stem of the preloaded barrel lock of FIG. 3.
Figure 6B:
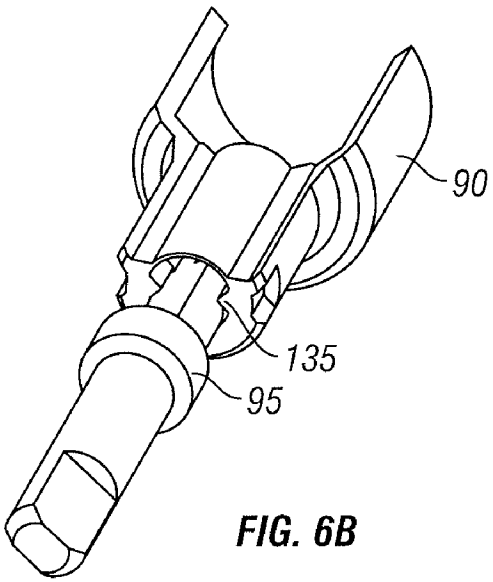
Figure 6A:
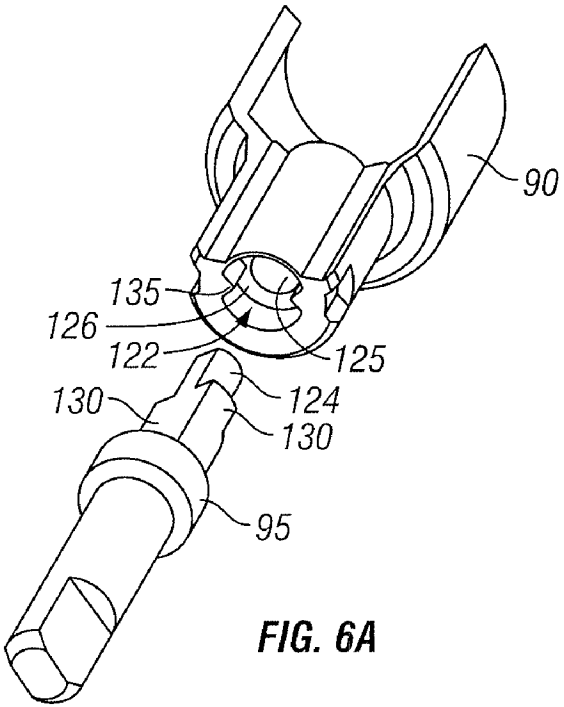
Figure 8:
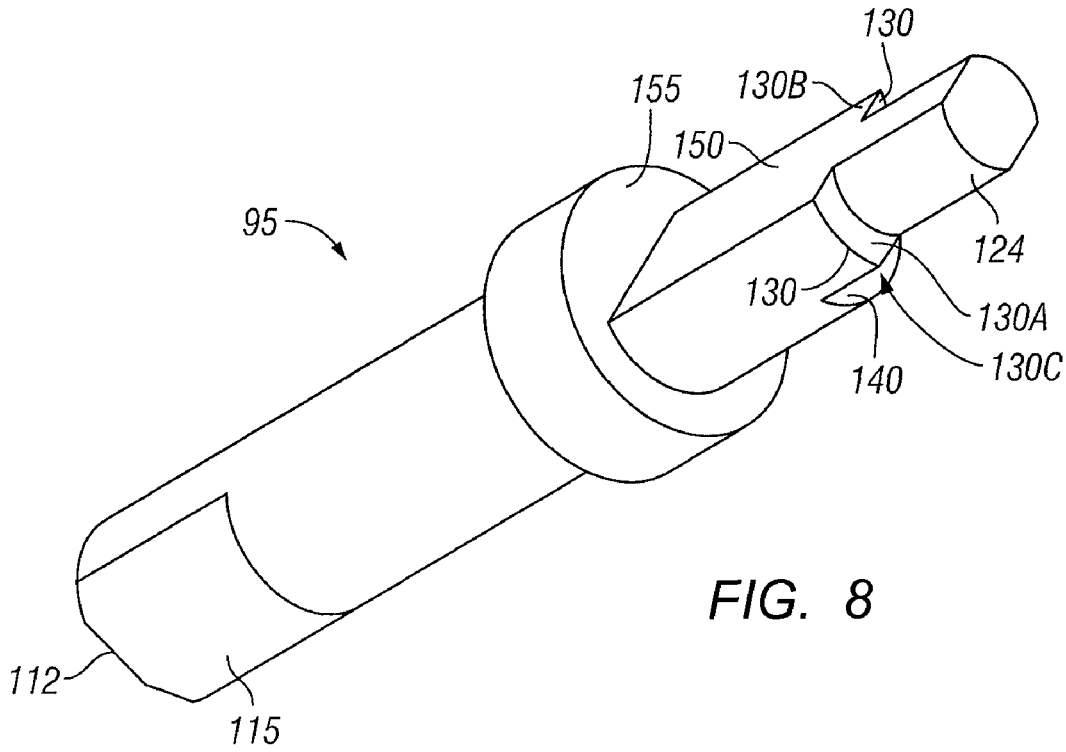
FIG. 8 is an enlarged perspective view of the stem of the preloaded barrel lock of FIG. 3.

The attachment end 124 also terminates in a shoulder 130. A front surface 130A of the shoulder 130 engages an abutment surface 126 that surrounds the bore 125 (FIGS. 6A and 8). The insertion of and relationship between the stem 95 and the cylinder 90 is illustrated in FIGS. 6A-6C.

Figure 7B:
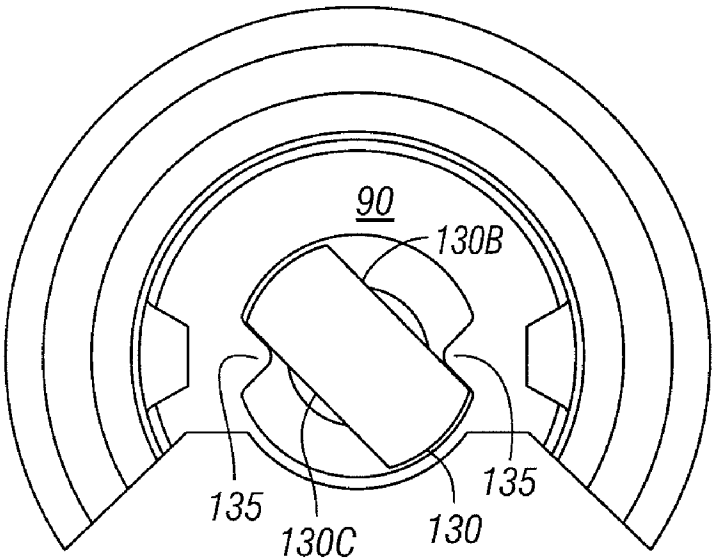
FIGS. 7A and 7B are cross-sectioned, enlarged front views of the preloaded barrel lock of FIG. 3 illustrating a rotational movement of the stem relative to the cylinder.
Figure 7A:
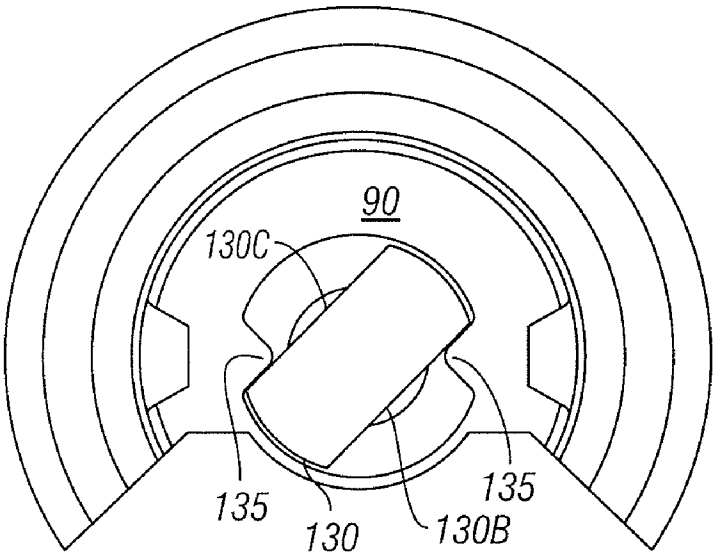

Referring now to FIGS. 5, 7A and 7B, the rotational movement of the stem 95 relative to the bore 125 is limited by two stops 135 located within the recess 122. The stops 135 limit rotational movement of the stem 95 by contacting front 130B and back 130C surfaces of the shoulder 130. The stops 135 permit the stem 95 to rotate approximately 90-degrees relative to the cylinder 90. As such, the stem can rotate so that the flats 115 are in contact with the balls 30 to facilitate removal of the inventive lock from a split ring.

Figure 9:
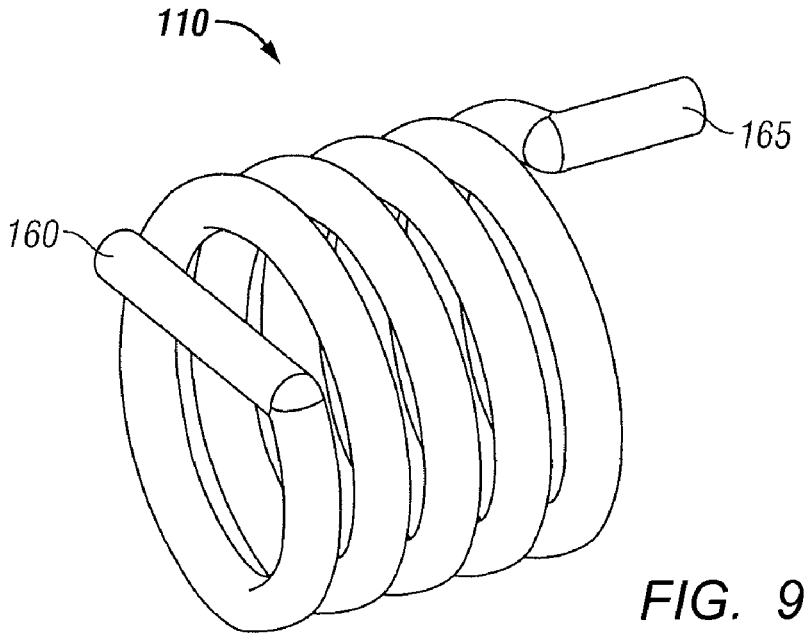
FIG. 9 is an enlarged perspective view of the biasing means of the preloaded barrel lock of FIG. 3.

As depicted in FIG. 8, rotation of the stem 95 relative to the cylinder is also guided by a second stem shoulder 140, which slidably engages an outer surface on the stem end 123 of the cylinder 90 that surrounds the recess 122. The shoulder 140 marks the beginning of a slightly wider, D-shaped stem portion 150. The D-shaped portion 150 terminates in a flange 155. After the flange 155, the diameter of the stem 95 decreases and remains substantially uniform up to the flats 115 of the terminal end portion 112. The D-shaped stem portion 150 of the stem is significant in that the biasing means 110, again preferably a spring, that connects the stem 95 and cylinder 90 has a corresponding D-shaped end 160 (FIG. 9). The D-shaped end 160 of the spring fits over the D-shaped portion 150 of the stem 95 and prevents it from moving freely within the spring 110 thereby allowing the spring 110 to exert a rotational force on the stem 95. The D-shaped end 160 of the spring 110 abuts the flange 155 of the stem 95.

Figure 10:
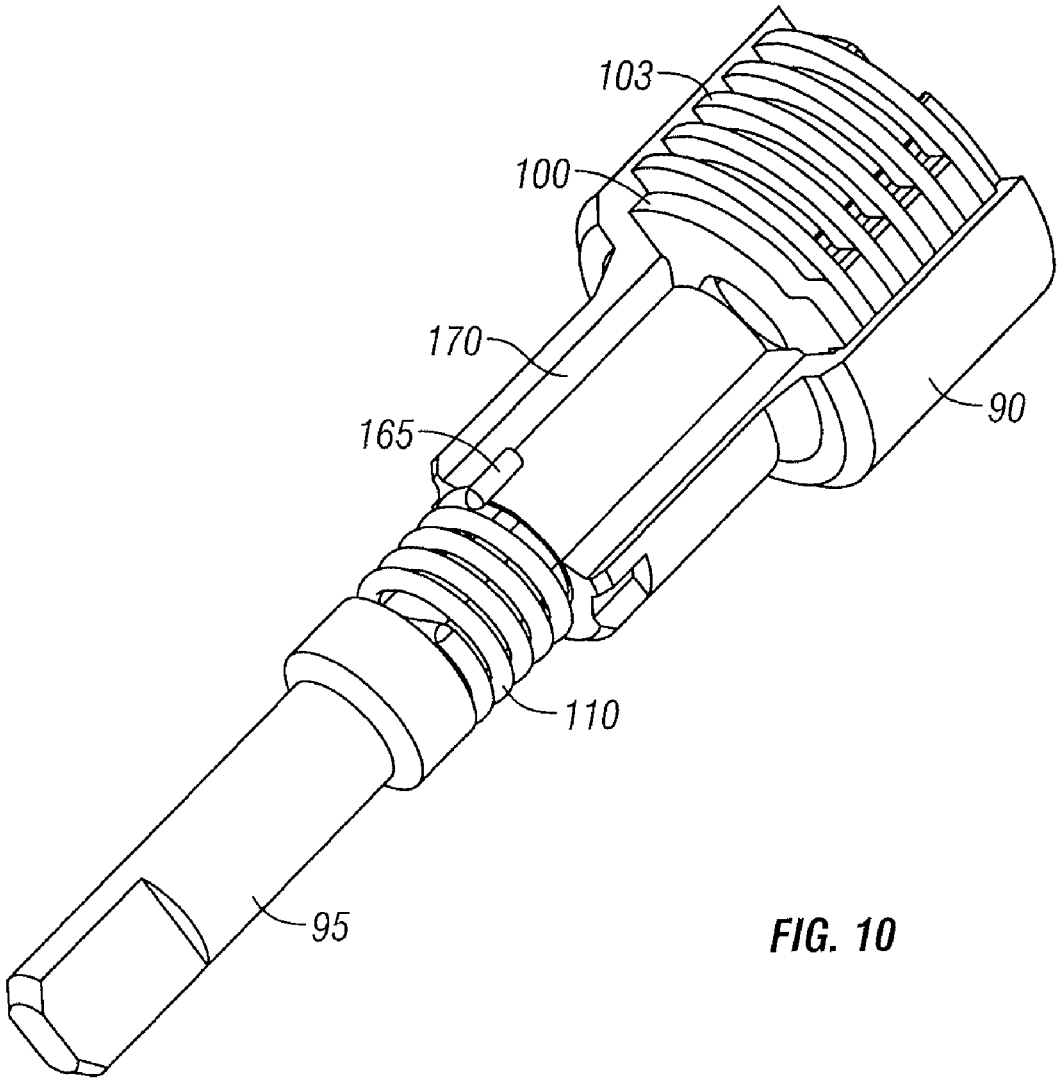
FIG. 10 is a perspective view of the cylinder, biasing means and stem of the preloaded barrel lock of FIG. 3.
Figure 11:
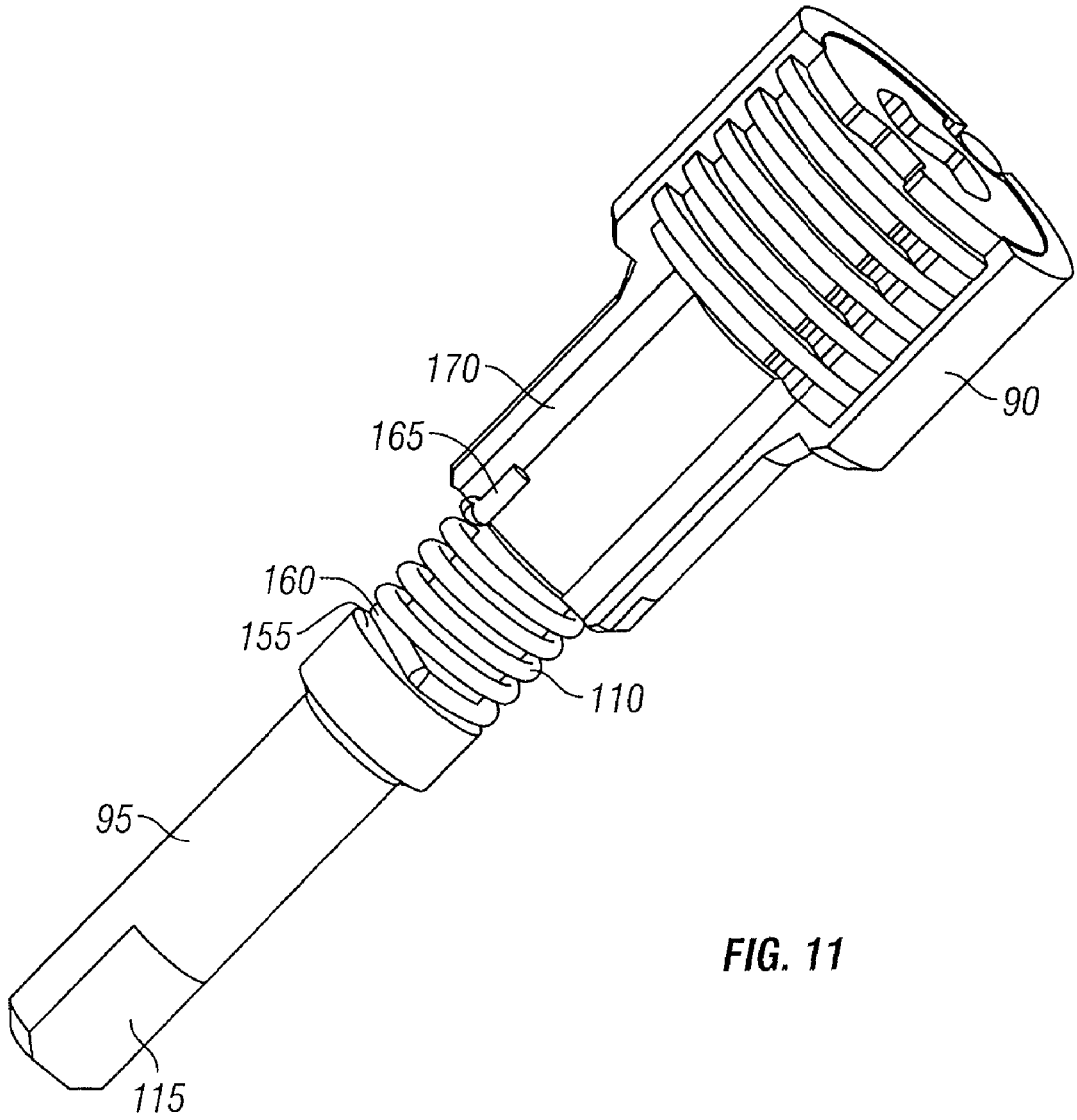
FIG. 11 is a rear perspective view of the cylinder, stem and biasing means of the preloaded barrel lock of FIG. 3.

The spring 110 is more clearly illustrated in FIG. 9. In addition to the D-shaped end 160, the spring 110 includes a depending leg 165. The depending leg 165 engages a channel 170 on an exterior surface of the stem end 123 of the cylinder 90 (FIG. 10). The relationship between the spring 110 and the stem 95 and cylinder 90 is depicted in FIGS. 10-11. More specifically, in FIG. 10 the depending leg 165 is shown in the channel 170 of the cylinder 90. The D-shaped end 160 of the spring 110 is shown engaging the D-shaped stem portion 150. The spring 110 functions both as a torsion spring biasing the stem, and as a compression spring urging the combination disks toward the open end 121 of the cylinder and the stem toward the balls 30.

This biased configuration is an important aspect of the present invention as the depending leg 165 of the spring 110 in channel 170 creates resistance as the D-shaped end 160 of the spring 110 attempts to rotate the stem 95 counterclockwise to lock the inventive lock. As will be appreciated, however, the channel 170 may have various shapes and configurations as long as it can fix an end of the spring or other biasing means to the cylinder creating rotational resistance between the cylinder and stem.

Moreover, as will be appreciated, the biasing means need not necessarily be a spring. For example, the stem and cylinder may be interconnected simply by a flexible or pliable material that allows for the relative rotational movement between the two components. Accordingly, depending on the configuration, it may be possible for the stem and cylinder to be unitary as long as relative rotational movement is possible.

In use, the barrel lock 10 is inserted into a collar 60 of a split ring 40 and, with the use of a key, the disks are rotated counterclockwise thereby rotating the cylinder to a locked position (FIGS. 2A-2C). This causes the stem 95 to rotate, biasing the balls 30 outward to engage the relatively shallow recesses 75 or groove in the interior 70 the collar 60 thereby preloading the lock. In this preloaded state, the stem is not fully rotated so that the cylindrical portions 120 are directly below the balls 30. As such, the balls 30 are not fully extended as their travel is limited by the relatively shallows recesses 75 in the collar 60. The stem 95 is rotationally biased by the spring 110, however, so that the balls 30 are also biased outward.

In view of the above, when the bushing 80 of the male portion 50 of the split ring is axially aligned with the interior 70 of the collar 60 the preloaded lock may then be pushed into the bushing causing the already biased stem to complete its rotation until the balls 30 are completely biased outward and protrude into the deeper bushing recesses 85 or groove securing the split ring 40.

The biased rotational movement of the stem relative to the cylinder makes this possible. In particular, as stated, when the balls are in the relatively shallow collar recesses they are not completely biased outward. While they are being forced outward by the stem and action of the spring, they cannot fully extend as their travel is limited by a bottom surface of the collar recesses. This partial extension of the balls allows them to pass out of the relatively shallow collar recess and into the deeper bushing recess when a user desires to lock the split ring. Once the balls have the clearance to extend fully outward into the deeper bushing recess, the biased stem rotates and the cylindrical portions of the stem are directly below the balls biasing them completely outward and placing the split ring in a locked position.

Referring back to FIGS. 2A-2C, preloading is facilitated by the relatively shallow recesses 75 in the interior 70 of the collar 60. The shallow recesses 75 also have a steeply inclined back wall 72 and a ramp like front wall 74 that facilitates the passage of the balls 30 beyond the recesses 75 and into the bushing 80 and bushing recesses 85.

This functionality is not possible with known disk style barrel locks as they include stem portions that are rotationally fixed relative to a cylinder portion. Movement of the cylinder in these locks correspondingly moves, in a direct drive fashion, the stem so that there can be no "intermediate position" in which the balls are biased outward to partially extend into a relatively shallow collar recess where the key can be removed from the lock.

To remove the inventive lock, the key is inserted and rotated. In the unlocking cycle, the cylinder and stem operate preferably, though not necessarily, in a direct drive fashion and rotation of the cylinder rotates the stem correspondingly so that the flat are directly underneath the balls and the lock may be extracted from a split ring.

As will be appreciated, the barrel lock of the present invention may be partially installed within the collar of a split ring at the factory, so as to enable complete locking of the split ring in the field merely by pushing the barrel lock completely into the collar. Thus, installation time is reduced, while increasing the ease of installation. Moreover, installers of these preloaded barrel locks need not have access to a key to facilitate locking of the barrel lock in the field.

Figure 12:
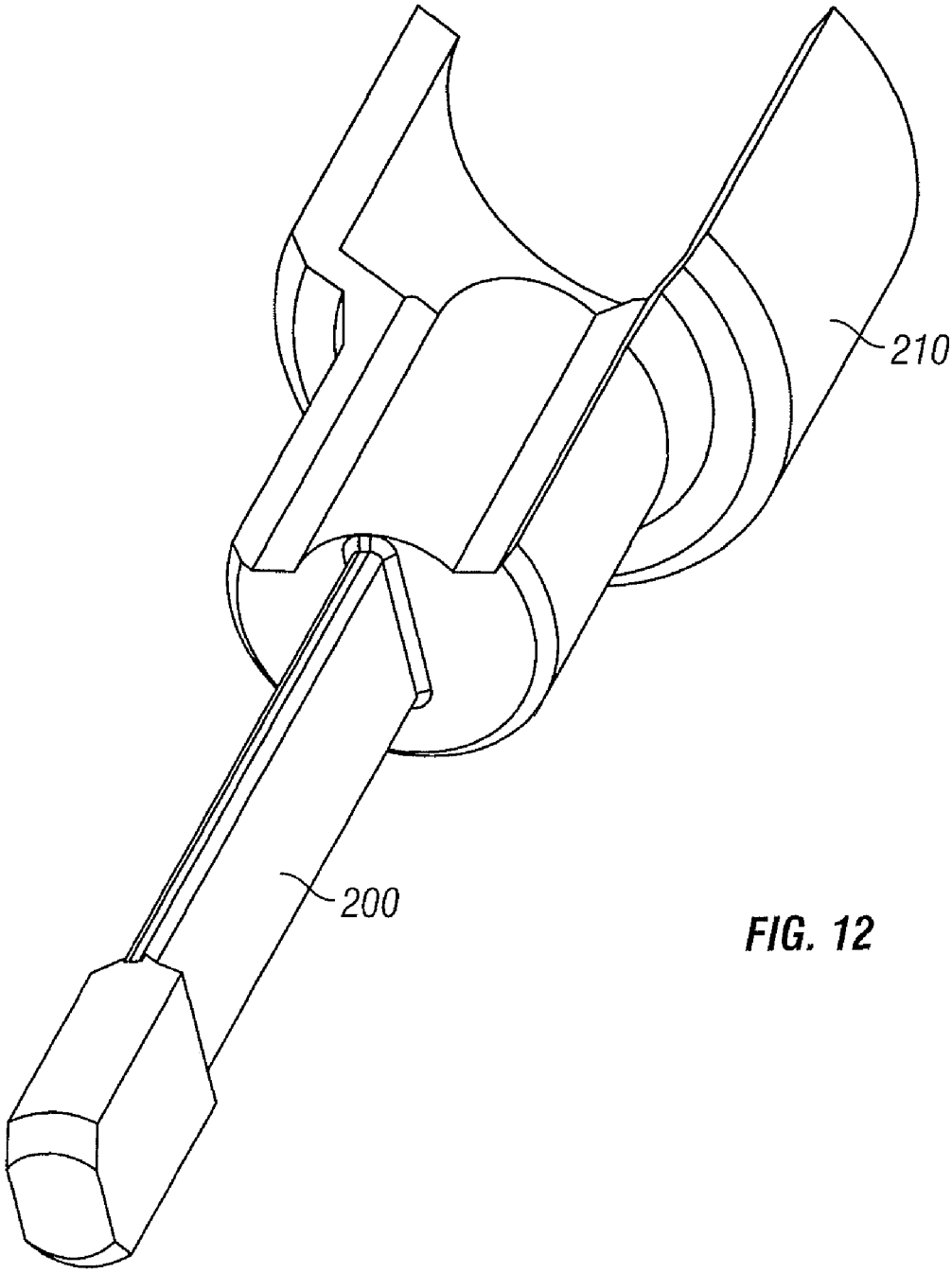
FIG. 12 is a perspective view of a cylinder, stem and biasing means according to an alternative embodiment of the present invention.
Figure 13B:
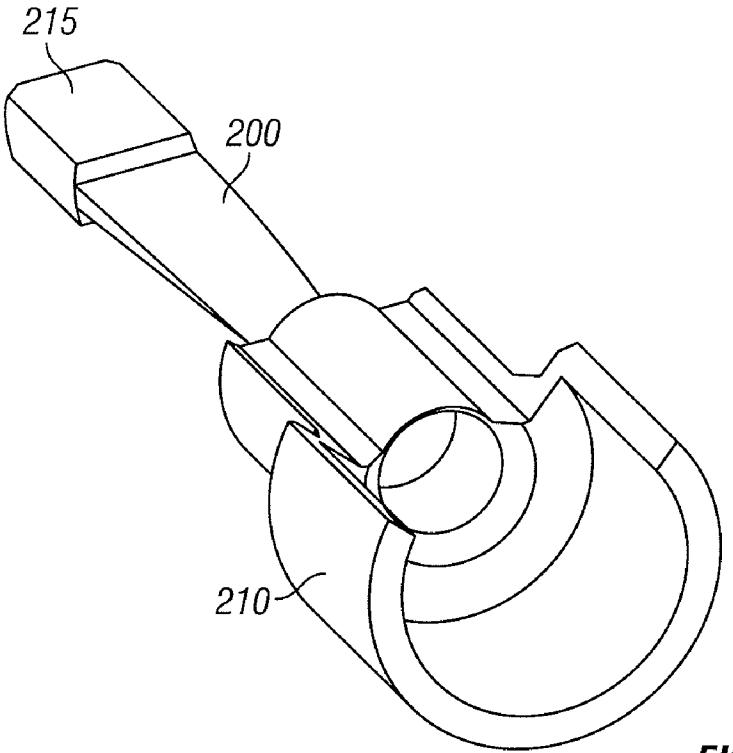
FIGS. 13A and 13B are perspective views of the cylinder, stem and biasing means of FIG. 12.
Figure 13A:
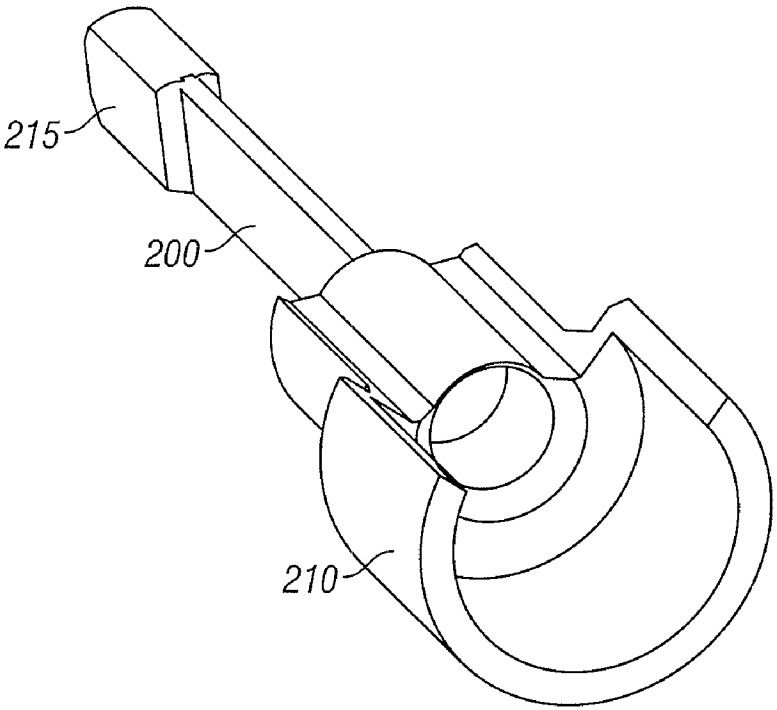

Referring now to FIGS. 12, 13A and 13B, illustrating an alternative embodiment of the present invention, the biasing means need not be a spring and the stem and cylinder need not be separate components for biased relative rotational movement between the components. For example, as depicted, the stem 200 and cylinder 210 may be unitary. In this case, the stem 200 is capable of rotational movement relative to the cylinder 210 due to its relative thinness and flexibility of the material of the stem 200. Moreover, biasing is accomplished by the material of the stem 200 and the fact that the stem 200 and cylinder 210 are one-piece. Accordingly, depending on the configuration, it may be possible for the stem and cylinder to be unitary while retaining the relative rotational functionality critical to the present invention.

FIGS. 13A and 13B graphically depict how a unitary stem 200 cylinder 210 design would operate. As shown, in FIG. 13A the stem 200 is in a first position in which the balls (not shown) would be biased outward. FIG. 13B depicts the stem 200 rotated 90-degrees so that flats 215 would be beneath the balls (not shown). In this position, however, the stem 200 would be rotationally biased urging the balls outward toward a locked position while at the same time allowing the balls to be held in an intermediate biased position to facilitate preloading.

In sum, the present invention provides a secure disk-style barrel lock that may be preloaded into a split ring eliminating the need for an installation key. This increases security for utilities employing such locks and provides an ease of installation. As stated, while there are known locks that may be preloaded into a split ring, all are plunger style, which can have significant limitations and drawbacks. While these drawbacks can be addressed with disk style barrel locks, no known disk style barrel lock is preloadable. Known disk locks are not preloadable, as they do not include a stem and cylinder that provide for biased relative rotational movement.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A lock assembly, said assembly comprising:

a first lock portion, said first lock portion having an open end which receives a key;

a second lock portion operatively connected to said first lock portion;

a torsion spring interposed between said first lock portion and said second lock portion and operatively attached to said first lock portion and said second lock portion such that rotation of one of said first and second lock portions to a first position causes said torsion spring to bias the other of said first and second lock portions;

a housing which contains said first and second lock portions and said torsion spring;

apertures in said housing from which balls are selectively biased;

a terminal end of said second lock portion, said terminal end having a flats portion and an engagement portion; and wherein said engagement portion of said terminal end of said second lock portion biases said balls from said apertures to a locked position of said lock assembly and said flats portion allows said balls to retreat into said apertures to an unlocked position; and wherein said second lock portion is capable of biased rotational movement relative to and independent of said first lock portion such that said lock assembly can be held in an intermediate position between said locked and unlocked positions in which said balls are urged partially out of said apertures by said rotationally biased engagement portion enabling said lock assembly to be preloaded into a locking device thereby eliminating the need for an installation key.

2. The lock assembly of claim 1, further comprising a split ring locking device, said split ring including:

a curved sidewall having a first end and a second end;

a collar on said first end having a bore which receives said lock assembly, said bore including at least one relatively shallow aperture;

a bushing on said second end with an opening that receives said lock assembly, said bushing opening including at least one relatively deep aperture; and wherein said lock assembly may pass through said bore into said bushing opening to lock said assembly when said collar and bushing are axially aligned.

3. The lock assembly of claim 2, wherein said balls are biased partially out of said apertures of said housing and into said at least one relatively shallow aperture of said bore of said collar to preload said lock assembly.

4. The lock assembly of claim 3, wherein when said bushing is axially aligned with said collar preloaded with said lock assembly, the assembly may be pushed axially into said bushing thereby disengaging said balls from said at least one relatively shallow aperture and forcing said biased balls into said at least one relatively deep aperture thereby locking said split ring.

5. A barrel lock with a rotating locking mechanism, said barrel lock comprising:

a stem, said stem having a terminal end portion which locks and unlocks said barrel lock;

a cylinder having a first end and a second end, said first end containing a rotating locking mechanism and said second end including a means for rotatably attaching said stem to said cylinder;

a torsion spring interposed between said stem and said cylinder and operatively attached to said stem and said cylinder for rotationally biasing said stem relative to said cylinder when said cylinder is rotated to a preloaded position;

a housing which contains said stem, cylinder, means for rotatably attaching said stem, and said torsion spring;

apertures in said housing from which balls are selectively biased;

said terminal end portion of said stem having a flats portion and an engagement portion;

wherein said engagement portion of said terminal end of said stem biases said balls from said apertures to a locked position of said lock assembly and said flats portion allows said balls to retreat into said apertures to an unlocked position; and wherein said stem is capable of biased rotational movement relative to and independent of said cylinder such that said barrel lock can be held in an intermediate position between said locked and unlocked positions in which said balls are biased partially out of said apertures enabling said barrel lock to be preloaded into a lock assembly thereby eliminating the need for an installation key.

* * * * *